US005848924A

United States Patent [19]

Langreck

[11] Patent Number: 5,848,924

[45] Date of Patent: Dec. 15, 1998

[54] BALL BEARING OAR LOCK DEVICE

[76] Inventor: Patrick J. Langreck, 8312 Millcreek Rd., Marshfield, Wis. 54449

[21] Appl. No.: 42,523

[22] Filed: Mar. 16, 1998

[51] Int. Cl.[6] ..... B63H 16/06

[52] U.S. Cl. ..... 440/106; 416/74

[58] Field of Search ..... 440/104–110; D12/215; 416/74; 384/482

[56] References Cited

U.S. PATENT DOCUMENTS

| | | | |
|---|---|---|---|
| 692,845 | 2/1902 | Garrett, Jr. | 440/109 |
| 2,550,625 | 4/1951 | Vick | 440/107 |
| 3,404,414 | 10/1968 | Goserud | 440/107 |
| 4,940,340 | 7/1990 | Durham | 384/482 |

*Primary Examiner*—Jesus D. Sotelo

*Attorney, Agent, or Firm*—Skinner & Associates

[57] ABSTRACT

An oar lock device, comprising a socket member and an oar clamp member. The socket member has a bracket portion and a socket portion. The oar clamp member has a shaft, a shoulder portion and two oar brackets. The shaft is connected to the shoulder portion and rotates within the socket portion of the socket member. The oar is clamped between the oar brackets, which are attached to and rotate about the shoulder portion. The bracket portion of the socket member is attached to a boat. The oar can be rotated about a generally horizontal axis through the shoulder portion, and also can be rotated about a generally vertical axis through the socket portion. A preferred embodiment uses neoprene sealed ball bearings in the socket portion and the shoulder portion to greatly reduce friction and assist with a silent, smooth and rhythmic stroke motion.

17 Claims, 5 Drawing Sheets

BALL BEARING OAR LOCK DEVICE

BACKGROUND OF THE INVENTION

1. Field of the Invention

The present invention relates, generally, to oar lock devices. More particularly, the invention relates to oar locks that are portable, efficient, smooth, and quiet.

2. Background Information

The state of the art includes various oar lock devices. U.S. Pat. No. D306,996 entitled "Oar Lock" issued to Scott shows an oar lock formed with a vertical shaft and a vertically aligned annular ring for receiving a generally horizontal oar. U.S. Pat. No. 4,052,951 entitled "Rowing Device for a Forward Facing Rower" issued to Farr shows U-shaped oarlocks in a second class lever oarlock design that permits a rower to face forward. U.S. Pat. No. 4,086,868 entitled "Oar Lock Attachment" issued to Lutters shows a removable attachment for clamping oarlock sockets to small boats. U.S. Pat. No. 4,290,156 entitled "Oar Lock Seat" issued to Rawson shows two gunnel mounted sliding oar lock units used on inflatable rafts. U.S. Pat. No. 4,309,173 entitled "Oarlock for Inflatable Boat" issued to Leber shows a rowlock fitting for inflatable boats, including a rigid C-shaped socket. U.S. Pat. No. 4,623,315 entitled "Oarlock" issued to Carter shows an oarlock comprising a base and two upwardly extending curvilinear legs that form a ring with an opening. An oar is held within the ring and passes into and out of the ring through the opening. U.S. Pat. No. 4,662,849 entitled "Oar Lock" issued to Loerch shows an oar lock including an elbow with two legs. The oar shaft can pivot vertically and horizontally about both legs of the elbow. A body protrusion serves to limit the oar shaft feathering rotation. U.S. Pat. No. 4,941,855 entitled "Oarlock" issued to Agner shows an oarlock comprising a pin adapted to be mounted for pivotal movement about a generally vertical axis and an oar supporting member mounted on the upper portion of the pin for pivotal movement about a generally horizontal axis.

These devices are believed to have significant limitations and shortcomings. Specifically, a considerable amount of friction accompanies movement of the oars within the oar lock. This friction makes rowing difficult and noisy. In addition, the oar shafts may be subjected to unusual wear if the oar shafts move with respect to the oar locks. Furthermore, some of the known oar locks use joints comprising metal shafts or pins riding within metal sockets. These joints are susceptible to corrosion, especially by salt water, and to contamination from other debris. Corroded or contaminated joints produce additional friction forces.

Applicant's oar lock provides for an efficient, smooth and quite rotation about both a vertical axis and a horizontal axis, is durable and resistant to corrosion and other contamination, and is believed to constitute an improvement over the known art.

BRIEF SUMMARY OF THE INVENTION

The present invention provides an oar lock device which generally comprises a socket member having a bracket portion and a socket portion, and further comprises an oar clamp member having a shaft, a shoulder portion, and at least one oar bracket for securing an oar. The oar lock device is mountable to a boat using the bracket portion. The shaft of the oar clamp member is received within the socket portion in such a manner as to rotate the oar in a generally horizontal plane about a generally vertical axis corresponding to the longitudinal axis of the shaft. The oar bracket is attached to the shoulder portion in such a manner as to allow the oar to rotate in a generally vertical plate about a generally horizontal axis. Thus the shoulder portion and socket portion cooperate to allow the oars to rotate in a natural three dimensional motion.

The bracket portion of the socket member is preferably adjustable to fit on boats of different sizes and shapes. The socket portion comprises a cylindrically shaped socket having a neoprene sealed bearing pressed into each open end of the socket. The shoulder portion of the oar clamp member comprises a cylindrically shaped shoulder having a neoprene sealed bearing pressed into each open end. Preferably a pair of oar brackets are used to clamp around an oar shaft. One end of each oar bracket is attached to a journal shaft within the bearings. The shaft is attached to the outside surface of the shoulder and is sized to fit within the bearings in the socket of the socket member.

Significant features of the oar lock invention include: (1) its resistance to corrosion and contamination; (2) its durability; (3) its precision design, (4) its portability around a boat and among boats; (5) its low friction contribution to an efficient rowing motion; (6) its virtually silent motion; and (7) its smooth rhythmic stroke motion.

The features, benefits and objects of this invention will become clear to those skilled in the art by reference to the following description, claims and drawings.

DETAILED DESCRIPTION

Figure 1:
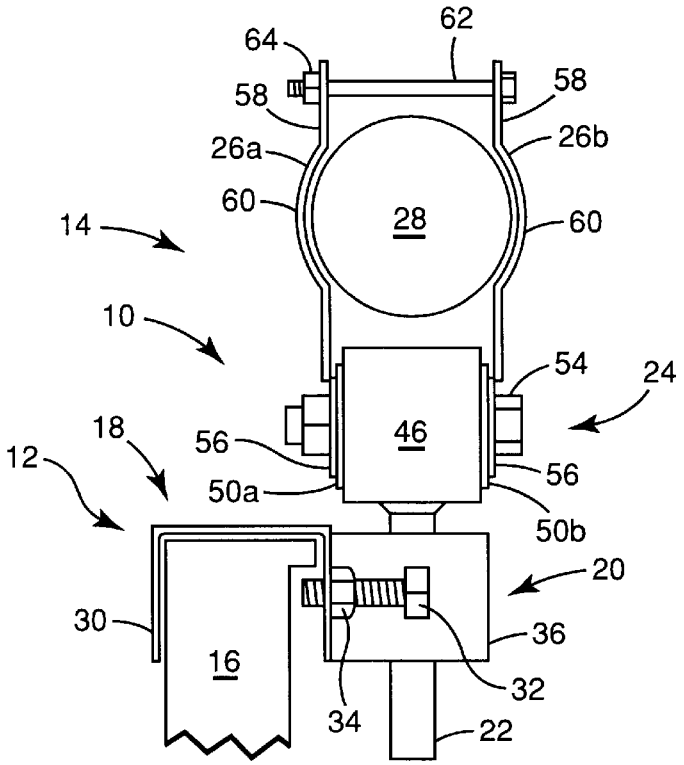
FIG. 1 is a planar view of the oar lock device showing the oar clamp member oriented longitudinally with respect to a boat.
Figure 2:
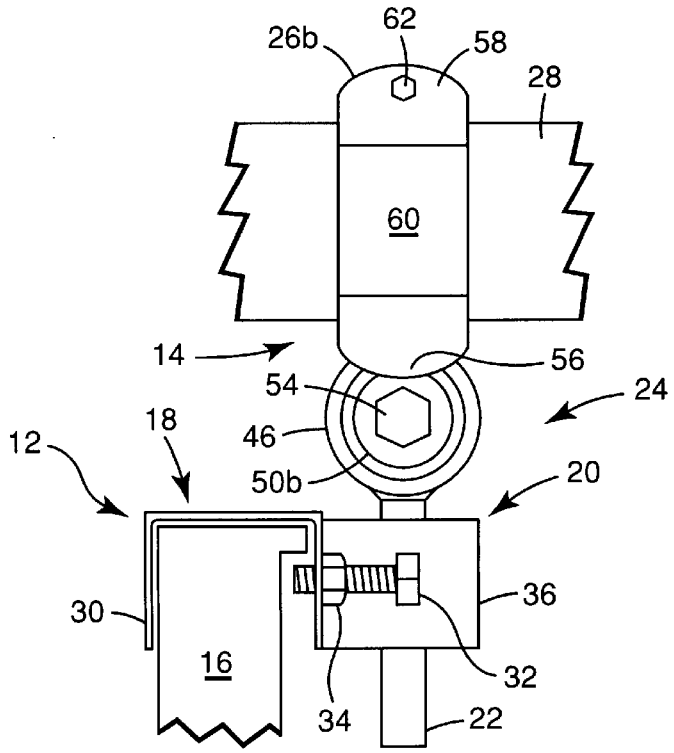
FIG. 2 is a planar view of the oar lock device of FIG. 1 showing the oar clamp member oriented laterally with respect to a boat.
Figure 3:
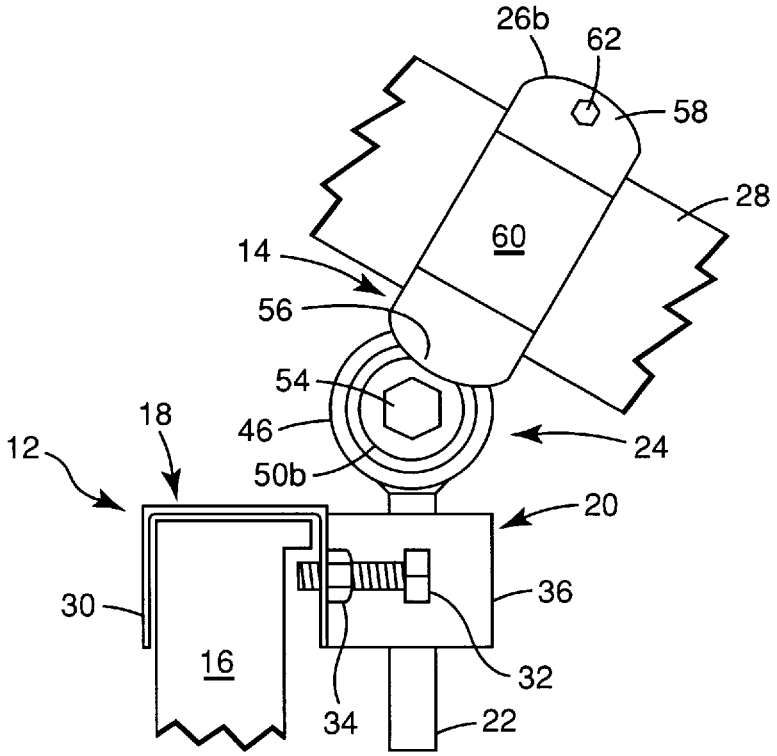
FIG. 3 is a planar view of the oar lock device of FIG. 2, further showing the oar brackets tilted.

Referring to FIGS. 1–3, an example of the preferred embodiment of the present invention is illustrated and generally indicated by the reference numeral 10. The oar lock device 10 is described below first in terms of its major structural elements and then in terms of its secondary structural and/or functional elements which cooperate to promote an efficient, quiet, smooth and rhythmic oar stroke.

Figure 4:
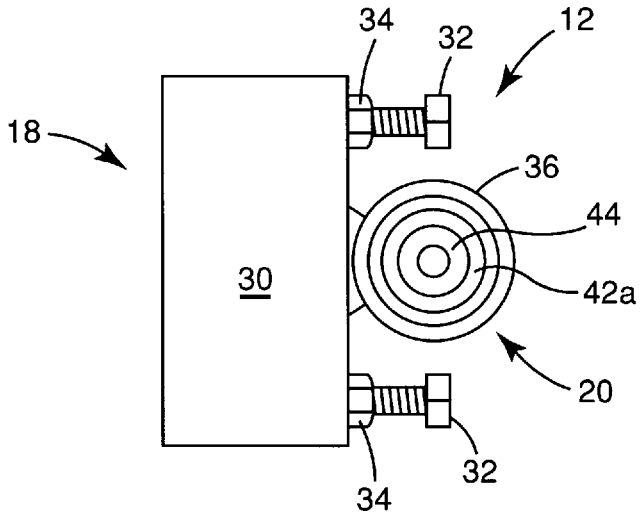
FIG. 4 is a top planar view of the socket member of the oar lock device of FIG. 1.
Figure 5:
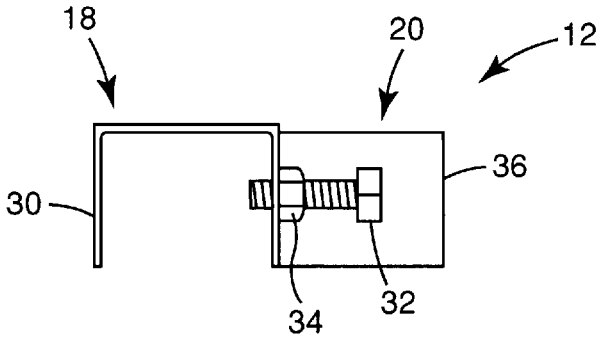
FIG. 5 is a side planar view of the socket member of FIG. 4.

The oar lock device 10 generally comprises a socket member 12 and an oar clamp member 14. The adjustable socket member 12 can be installed, removed, and reinstalled on a variety of boats 16. Referring also to FIGS. 4 and 5, the socket member 12 generally comprises a bracket portion 18 and a socket portion 20 attached to the bracket portion 18. In a preferred embodiment, the bracket portion 18 and socket portion 20 are constructed from a durable metal such as steel and are welded together. However, it is anticipated that the bracket portion 18 and socket portion 20 could be molded together as a unitary structure using a strong plastic material. The bracket portion 18 provides a rigid means for securing the oar lock device to the boat 16, and the socket portion 20 provides a secure means for rotatably mounting the oar clamp member 14 to the boat 16.

Figure 7:
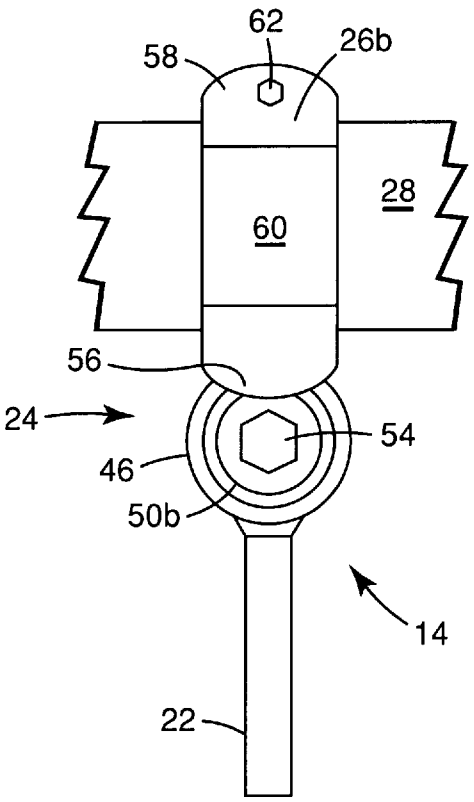
FIG. 7 is a front planar view of the oar clamp member of FIG. 6.
Figure 6:
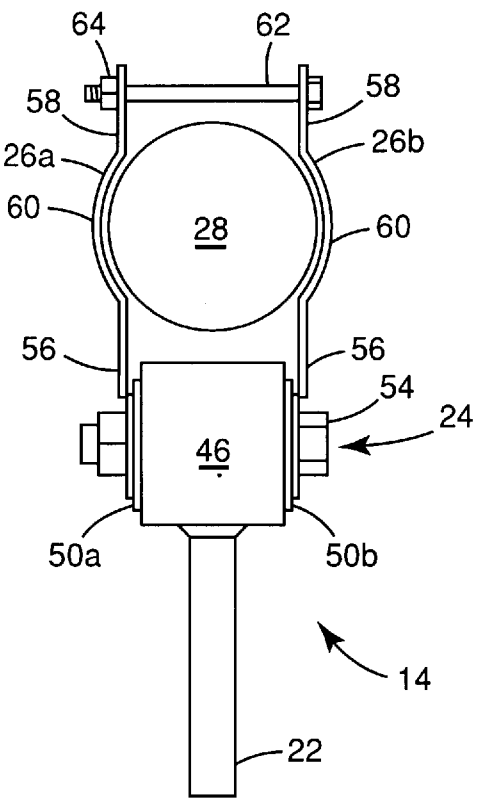
FIG. 6 is a side planar view of the oar clamp member of the oar lock device of FIG. 1.

Referring also to FIGS. 6 and 7, the oar clamp member 14 generally comprises a shaft 22, a shoulder portion 24, and preferably a pair of oar brackets 26*a* and 26*b*. The shaft 22 is attached to the shoulder portion 24 and is constructed and arranged to be received within the socket portion 20 of the socket member 12. The shaft 22 rotates about its longitudinal axis within the socket portion 20, which corresponds to a generally vertical axis during normal use when the oar lock device 10 is mounted on a boat 16. The oar brackets 26*a* and 26*b* are rotatably mounted to the shoulder portion 24. The oar brackets 26*a* and 26*b* rotate about an axis that is approximately perpendicular to the longitudinal axis of the shaft 22, which corresponds to a generally horizontal axis during normal use when the oar lock device 10 is mounted on a boat 16. The oar brackets 26*a* and 26*b* provide a means for securely clamping a shaft of an oar 28. Thus the bracket portion 18, socket portion 20, shaft 22, shoulder portion 24 and oar brackets 26*a* and 26*b* cooperate with each other to securely and operably mount the oar 28 to the boat 16. The oar 28 naturally moves through three dimensions during a stroke as it rotates about the vertical and horizontal axes. The bracket portion 18 is securely attached to the boat to transmit the force associated a stroke into the motion of the boat.

Referring again to FIGS. 4 and 5, the bracket portion 18 of the socket member 12 has a frame or bracket 30, and further has an adjustable fastening mechanism for securely attaching the oar lock device 10 to boats 16. The fastening mechanism preferably comprises two threaded fasteners or bolts 32, and two nuts 34 that form an internally threaded portion through which the bolts 32 are screwed. The nuts 34 are preferably attached or welded over apertures (not shown) in the bracket 30. The bracket 30 is secured to the boat 16 by screwing the bolts 32 into the nuts 34 and through the apertures until they contact the boat 16. Alternatively to using nuts 34, the internally threaded portions could be formed by tapping threads into the apertures in the bracket 30. Additionally, a protective shoe or plate could be placed on the screw end of each bolt 32 to prevent damage when the bolt 32 is tightened against the boat 16.

The socket portion 20 of the socket member 12 has a cylindrically shaped socket 36 with a top end 38 and a bottom end 40. A neoprene sealed ball bearing 42*a* is pressed into the top end 38, and a second neoprene sealed ball bearing 42*b* is pressed into the bottom end 40. The bearings 42*a* and 42*b* are preferably journal bearings with an annular bearing surface 44. The shaft 22 is sized to form a journal that precisely fits within the annular bearing surface 44 of each of the bearings 42*a* and 42*b* to securely and operably mount the oar clamp member 14 to the socket member 12. The neoprene sealed ball bearings 42*a* and 42*b* firmly support the shaft 22 within both bearing surfaces 44 at two places along the length of the shaft 22, and allow the shaft 22 to undergo a precise rotation about its longitudinal axis.

Figure 8:
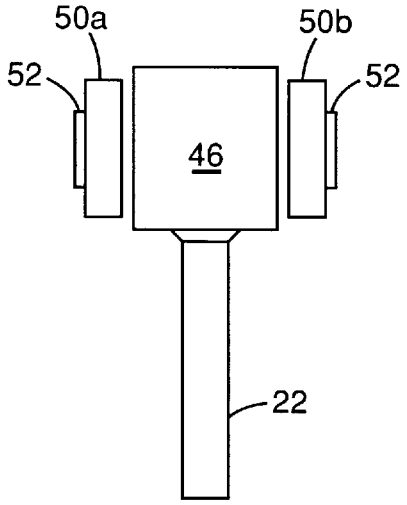
FIG. 8 is an exploded partial side view of the oar clamp member of FIG. 6 showing the bearings.
Figure 9:
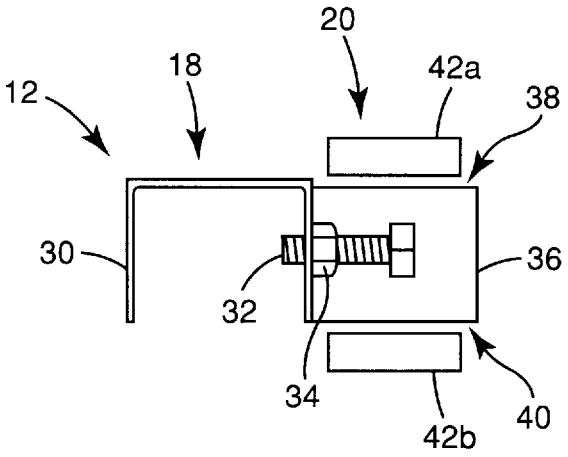
FIG. 9 is an exploded view of the socket member of FIG. 4 showing the bearings.

Referring again to FIGS. 6, 7 and 8, the shoulder portion 24 of the oar clamp member 14 includes a cylindrically shaped shoulder 46 with an open first end 48*a* and an open second end 48*b*. The shaft 22 is attached to the outside surface of the shoulder 46 and extends down through the socket 36. Preferably, both the shaft 22 and shoulder 46 are constructed of metal and are welded together. However, it is anticipated that the shaft 22 and shoulder 46 could be manufactured from plastic with a unitary construction. The shaft 22 forms a pin that is easily removed from and reinserted into the socket.

A neoprene sealed ball bearing 50*a* is pressed into the first end 48*a* of the shoulder 46, and a second neoprene sealed ball bearing 50*b* is pressed into the second end 48*b*. The bearings 50*a* and 50*b* are preferably journal bearings with an annular bearing surface 52. A central shaft 54 extends through the shoulder 46 and through the annular bearing surfaces 52 of each bearing 50*a* and 50*b*. The central shaft 54 is sized to form a journal that precisely fits within the annular bearing surfaces 52. The neoprene sealed ball bearings 50*a* and 50*b* firmly support the central shaft 54 within both bearing surfaces 52 at two places along the length of the central shaft 54, and allow the central shaft 54 to undergo a precise rotation about its horizontal axis. The generally parallel oar brackets 26*a* and 26*b* each have a proximal end 56 with a proximal aperture, and further have a distal end 58 with a distal aperture. The central shaft 54 extends through the proximal aperture of each proximal end 56 and the brackets 26*a* and 26*b* are tightened against the raised bearing surfaces 52. The central shaft 54 is preferably a threaded bolt. A nut tightens the brackets 26*a* and 26*b* against the bearing surfaces 52. The brackets 26*a* and 26*b* preferably have opposing concave portions 60 approximately midway between the proximal end 56 and the distal end 58. These concave portions are suitably shaped to receive an oar 28. The oar 28 is secured within the brackets 26*a* and 26*b* by clamping or tightening the distal ends 58 together. Preferably a bolt 62 extends through the apertures of each distal end 58 and a nut is tightened on the bolt 62 to secure the oar 28 between the brackets 26*a* and 26*b*.

The neoprene sealed bearings 42*a*, 42*b*, 50*a* and 50*b* in both the socket 36 and the shoulder 46 provide a smooth, rhythmic, virtually silent natural stroke motion. It is estimated from calculations that the bearings provide for 50% easier oaring then if a pin rides within a socket without bearings. The sealed bearings also make the oar lock device 10 resistant to corrosion from sea water and contamination from other debris, and further makes the oar lock device 10 resistant to wear. The precision design between the socket 36 and the bearings 42*a* and 42*b*, between the shoulder 46 and the bearings 50*a* and 50*b*, between the shaft 22 and the bearing surfaces 44 in the socket 36, and between the central shaft 54 and the bearing surfaces 52 in the shoulder 46 further promotes the efficient, smooth, and virtually silent stroke motion by eliminating non-productive motion caused by excessive mechanical tolerance build-up. The adjustable fastening mechanism of the bracket portion 18 enables the oar lock device 10 to be mounted in multiple places on the boat, to be removed from the boat, and remounted to the same or a different boat. Furthermore, the design of the shaft 22 and the socket portion 20 enable the oar 16 and oar clamp member 14 to be securely and operably mounted on the socket member 12 and to easily be removed from the socket member 12.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. An oar lock device, comprising:

(a) a socket member having a bracket portion and a socket portion, said socket portion having a top, a bottom, and a passage extending from said top to said bottom, said socket portion further having a generally cylindrical shape, a first bearing being pressed into said top and a second bearing being pressed into said bottom, both of said first bearing and said second bearing having an annular bearing surface; and (b) an oar clamp member having a shaft, a shoulder portion and at least one oar bracket, said shaft being connected to said shoulder portion and being rotatable within said socket portion of said socket member, said shaft being sized to fit within said bearing surface, and said at least one oar bracket being attached to said shoulder portion.

2. The oar lock device of claim 1, wherein said bracket portion comprises a bracket and an adjustable fastening mechanism for securing the bracket to a boat.

3. The oar lock device of claim 2, wherein said fastening mechanism comprises at least one externally threaded fastener and at least one internally threaded portion, and wherein each of said at least one threaded fastener screws into a corresponding one of said at least one internally threaded portion and against the boat.

4. The oar lock device of claim 3, wherein said fastening mechanism comprises two externally threaded fasteners and two internally threaded portions.

5. The oar lock device of claim 3, wherein said bracket has at least one fastening aperture, and wherein each of said at least one internally threaded portion is a nut attached to said bracket around said at least one fastening aperture.

6. The oar lock device of claim 1, wherein said socket portion further comprises at least one bearing.

7. The oar lock device of claim 6, wherein said at least one bearing is a neoprene sealed bearing.

8. The oar lock device of claim 1, wherein said at least one oar bracket is constructed to secure an oar shaft.

9. The oar lock device of claim 1, wherein said oar clamp member has a first oar bracket and an opposing second oar bracket, each of said oar brackets having a distal end and a proximal end, said proximal end of said first oar brackets being attached to a first side of said shoulder portion and said second oar bracket being attached to an opposite second side of said shoulder portion, said first oar bracket and said second oar bracket being rotatable about said shoulder portion, said distal end of said first and second oar brackets being tightened together to secure an oar shaft between said proximal ends and said distal ends of said oar brackets.

10. The oar lock device of claim 9, wherein said distal end of said first oar bracket and said distal end of said second oar bracket each have an aperture, said oar clamp member further comprising a threaded fastener inserted through both of said apertures in said distal ends and a nut tightened on said threaded fastener to secure the oar shaft between said first oar bracket and said second oar bracket.

11. An oar lock device, comprising:

(a) a socket member having a bracket portion and a socket portion; and (b) an oar clamp member having a shaft, a shoulder portion and at least one oar bracket, said shaft being connected to said shoulder portion and being rotatable within said socket portion of said socket member, and said at least one oar bracket being attached to said shoulder portion, said shoulder portion comprising a shoulder having a first side, a second side, and a passage extending from said first side to said second side, said shoulder portion further comprising at least one bearing.

12. The oar lock device of claim 11, wherein said at least one bearing is a neoprene sealed bearing.

13. An oar lock device, comprising:

(a) a socket member having a bracket portion and a socket portion; and (b) an oar clamp member having a shaft, a shoulder portion and at least one oar bracket, said shaft being connected to said shoulder portion and being rotatable within said socket portion of said socket member, and said at least one oar bracket being attached to said shoulder portion, said shoulder portion comprising a shoulder having a first side, a second side, and a passage extending from said first side to said second side, said shoulder having a generally cylindrical shape, said shoulder portion further comprising a first bearing pressed into said first side and a second bearing pressed into said second side.

14. An oar lock device, comprising:

(a) a socket member having a bracket portion and a socket portion; and (b) an oar clamp member having a shaft, a shoulder portion and at least one oar bracket, said shaft being connected to said shoulder portion and being rotatable within said socket portion of said socket member, and said at least one oar bracket being attached to said shoulder portion, said shoulder portion comprising a shoulder having a first side, a second side, and a passage extending from said first side to said second side, said shoulder portion further comprising a central shaft extending from said first end through said passage to said second end, said oar clamp member having a first oar bracket and a second oar bracket, each of said oar brackets having a distal end and a proximal end, said proximal end of said first oar bracket being attached to said shaft at said first end of said shoulder, and said proximal end of said second oar bracket being attached to said shaft at said second end of said shoulder.

15. The oar lock device of claim 14, wherein said proximal end of each of said first and second oar brackets has an aperture, said central shaft comprising a threaded fastener that extends through said aperture of said first oar bracket, through said passage, and through said aperture of said second oar bracket, and further comprising a nut tightened on said threaded fastener to attach said brackets to said threaded fastener.

16. An oar lock device, comprising:

(a) a socket member having a bracket portion and a socket portion, said bracket portion including a bracket having a shape to fit on a boat, and further including an adjustable fastening mechanism for securing said bracket to said boat, said fastening mechanism comprising at least one externally threaded fastener and at least one internally threaded portion through which said threaded fastener is screwed, said socket portion having a cylindrical shape with a top, a bottom, and a passage extending from said top to said bottom, said socket further having a first bearing pressed into said top and a second bearing pressed into said bottom; and (b) an oar clamp member having a shaft, a shoulder portion, a first oar bracket, and an opposing second oar bracket, said shaft being connected to said shoulder portion and being rotatable within said socket portion of said socket member, said shoulder having a generally cylindrical shape with a first side, a second side, and a passage from said first side to said second side, said shoulder further comprising a third bearing pressed into said first side and a fourth bearing pressed into said second side, said shoulder portion further comprising a central shaft extending from said first end through said passage to said second end, each of said first oar bracket and said second oar bracket having a distal end and a proximal end, said proximal end of said first oar bracket being attached to said shaft at said first end of said shoulder, said proximal end of said second oar bracket being attached to said shaft at said second end of said shoulder, said first oar bracket and said second oar bracket being rotatable about said shoulder portion, and said distal end of said first oar bracket and said distal end of said second oar bracket being tightened together to secure an oar shaft between said proximal ends and said distal ends of said oar brackets.

17. A portable, efficient, smooth, quiet, durable, corrosion-resistant, precision, ball bearing oar lock device, comprising:

(a) a socket member having a bracket portion and a socket portion, said bracket portion including a bracket having a shape to fit on a boat, and further including two fastening apertures and an adjustable fastening mechanism for securing said bracket to said boat, said fastening mechanism comprising two externally threaded fasteners and two internally threaded nuts, each of said nuts being mounted to said bracket over one of said fastening apertures, said socket portion having a cylindrical shape with a top, a bottom, and a passage extending from said top to said bottom, said socket further having a first neoprene sealed bearing pressed into said top and a second neoprene sealed bearing pressed into said bottom; and (b) an oar clamp member having a shaft, a shoulder portion, a first oar bracket, and an opposing second oar bracket, said shaft being connected to said shoulder portion and being rotatable within said socket portion of said socket member, said shoulder having a generally cylindrical shape with a first end, a second end, and a passage from said first end to said second end, said shoulder further comprising a third neoprene sealed bearing pressed into said first end and a fourth neoprene sealed bearing pressed into said second end, said shoulder portion further comprising a central shaft extending from said first end through said passage to said open second end, each of said first oar bracket and said second oar bracket having a distal end and a proximal end, said proximal end of said first oar bracket being attached to said central shaft at said first end of said shoulder, said proximal end of said second oar bracket being attached to said central shaft at said second end of said shoulder, said first oar bracket and said second oar bracket being rotatable about said shoulder portion, said central shaft being a threaded fastener and nut, and said distal end of said first oar bracket and said distal end of said second oar bracket being tightened together using a threaded fastener and a nut to secure an oar shaft between said proximal ends and said distal ends of said oar brackets.

* * * * *